US009180703B2

(12) United States Patent
Hara et al.

(10) Patent No.: US 9,180,703 B2
(45) Date of Patent: Nov. 10, 2015

(54) RECORDING DEVICE

(71) Applicant: SEIKO EPSON CORPORATION, Tokyo (JP)

(72) Inventors: Osamu Hara, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/488,916

(22) Filed: Sep. 17, 2014

(65) Prior Publication Data

US 2015/0085045 A1 Mar. 26, 2015

(30) Foreign Application Priority Data

Sep. 24, 2013 (JP) ..... 2013-197065

(51) Int. Cl.

| | |
|---|---|
| ***B41J 2/01*** | (2006.01) |
| ***B41J 13/03*** | (2006.01) |
| ***B41J 11/00*** | (2006.01) |
| *B41J 11/06* | (2006.01) |

(52) U.S. Cl.

CPC ..... *B41J 13/03* (2013.01); *B41J 11/007* (2013.01); *B41J 11/06* (2013.01)

(58) Field of Classification Search

CPC ..... B41J 11/007; B41J 11/0085; B41J 3/60; B41J 11/001; B41J 11/0045

USPC ..... 347/104

See application file for complete search history.

(56) References Cited

FOREIGN PATENT DOCUMENTS

| | | |
|---|---|---|
| JP | 2007-152785 | 6/2007 |
| JP | 2008-037642 | 2/2008 |

OTHER PUBLICATIONS

Machine Translation of JP2008037642 A, Recording Medium Conveying Mechanism and Liquid Drop Discharging Device, Feb. 21, 2008, See Entire Document.*

* cited by examiner

*Primary Examiner* — Lisa M Solomon
(74) *Attorney, Agent, or Firm* — Workman Nydegger

(57) ABSTRACT

A recording device includes a head unit that ejects ink onto a target recording medium, and transport units that transport the target recording medium. The transport units are provided with driving rollers that are provided so as to come into contact with a first surface of the target recording medium, and that generate a delivery power in the target recording medium, and air delivery units that push the target recording medium against the driving rollers by applying air pressure to the driving rollers from a side of a second surface of the target recording medium.

12 Claims, 5 Drawing Sheets

RECORDING DEVICE

The entire disclosure of Japanese Patent Application No: 2013-197065, filed Sep. 24, 2013 is expressly incorporated by reference herein in its entirety.

BACKGROUND

1. Technical Field

The present invention relates to a recording device.

2. Related Art

Recording devices that transport a target recording medium using a transport unit that includes a driving roller are used in the related art. For example, in JP-A-2007-152785, a recording device that transports a target recording medium using a transport unit that is configured with a pair of rollers that have a driving roller and interposes the target recording medium.

Accordingly, in the recording devices of the related art, common recording devices transport a target recording medium using a transport unit that is configured by a pair of rollers that has a driving roller and interposes the target recording medium. In particular, among these kinds of roller pairs, a typical pair of rollers has a driven roller disposed on a recording surface side of the target recording medium, and the driving roller is disposed on a side that is opposite to the recording surface side.

However, in a recording device of the related art such as that mentioned above, there are cases in which transport defects (such as roller tracks) becoming imprinted onto the target recording medium, which arise as a result of the target recording medium being interposed by the pair of rollers.

In particular, there were cases in which the recording quality decreases as a result of the trail of the driven roller appearing on a side of the recording surface of the target recording medium.

SUMMARY

An advantage of some aspects of the invention is to suppress transport defects such as the imprinting of roller tracks that accompany transport of the target recording medium.

According to an aspect of the invention, there is provided a recording device including a head unit that ejects ink onto a target recording medium, and a transport unit that transports the target recording medium, in which the transport unit is provided with a driving roller that is provided so as to come into contact with a first surface of the target recording medium, and that generates a delivery power in the target recording medium, and an air delivery unit that pushes the target recording medium against the driving roller by applying air pressure to the driving roller from a side of a second surface of the target recording medium.

According to the aspect of the invention, the transport unit pushes the target recording medium against the driving roller with air pressure by delivering air from the air delivery unit from a side of a second surface of the target recording medium to a position at which the driving roller is provided, and transports the target recording medium by rotating the driving roller. That is, it is possible to transport the target recording medium without interposing the target recording medium between a pair of rollers. Therefore, it is possible to suppress transport defects such as the imprinting of roller tracks that accompany transport of the target recording medium. In particular, by setting the second surface as a recording surface of the target recording medium, it is possible to prevent the trail of a driven roller from appearing on a side of the recording surface of the target recording medium.

In the recording device of the aspect of the invention, the transport unit may include, in a transport direction of the target recording medium, a first transport unit that is provided on an upstream side in the transport direction of the head unit, and a second transport unit that is provided on a downstream side in the transport direction of the head unit.

According to the aspect of the invention, the transport units are provided on both sides of the head unit in the transport direction of the target recording medium with the head unit interposed therebetween. Therefore, since it is possible to push the target recording medium against the driving roller on both sides of the head unit in the transport direction of the target recording medium, it is possible to more effectively suppress transport faults such as jamming.

In the recording device of the aspect of the invention, the first transport unit of the transport unit may be provided between a setting unit that sets the target recording medium on which recording is to be performed by the head unit, and the head unit, and the air delivery unit may be a fan that jets out ions or a fan that jets out hot air.

In this instance, the "setting unit" is a unit that sets the target recording medium in order to dispatch the target recording medium on which recording is to be performed to the head unit. For example, the setting unit corresponds to a setting unit that sets the roll-shaped target recording medium, or a unit that is referred to as a paper supply (feeding) tray or a paper supply (feeding) cassette that sets single sheets of the target recording medium.

According to the aspect of the invention, the first transport unit is provided between a setting unit that sets the target recording medium on which recording is to be performed by the head unit, and the head unit, and the air delivery unit is a fan that jets out ions or a fan that jets out hot air. That is, a fan that jets out ions or a fan that jets out hot air is provided on an upstream side in the transport direction of the target recording medium with respect to the head unit. Therefore, before recording with the head unit, it is possible to improve recording quality by removing static electricity of the target recording medium using ions, or it is possible to heat the target recording medium with hot air. Therefore, it is possible to reduce costs by causing the first transport unit to also have a role of a static electricity removal unit or a heating unit of the target recording medium.

In the recording device of the aspect of the invention, the second transport unit of the transport unit may be provided between the head unit and a recovery unit that recovers a target recording medium upon which recording has been performed by the head unit, and the air delivery unit may be a fan that jets out hot air.

In this instance, the "recovery unit" is a unit that performs winding, stacking, and the like, of the target recording medium in order to recover a target recording medium on which recording has been performed. For example, the recovery unit corresponds to a winding unit that winds the roll-shaped target recording medium, a receiving unit for discharge that stacks single sheets of the target recording medium, or a unit that is referred to as a paper output (discharge) tray or a paper output (discharge) cassette.

According to the aspect of the invention, the second transport unit is provided between the head unit and a recovery unit that recovers a target recording medium upon which recording has been performed by the head unit, and the air delivery unit is a fan that jets out hot air. That is, a fan that jets out hot air is provided on a downstream side in the transport direction of the target recording medium with respect to the head unit.

Therefore, it is possible to volatilize a volatile constituent in the ink that is ejected onto the target recording medium using the hot air after recording has been performed by the head unit. Therefore, it is possible to reduce costs by causing the transport unit to also have a role of an ink drying unit.

In the recording device of the aspect of the invention, a pretreatment unit that attaches a pretreatment agent that suppresses smearing of ink to the target recording medium may be further provided, the head unit may record by ejecting the ink onto the target recording medium to which the pretreatment agent has been attached, the first transport unit of the transport unit may be provided between a setting unit that sets the target recording medium on which recording is to be performed by the head unit, and the head unit, and the pretreatment unit is provided between the setting unit and the first transport unit, or between the first transport unit and the head unit.

According to the aspect of the invention, the first transport unit is provided between a setting unit that sets the target recording medium on which recording is to be performed by the head unit, and the head unit, and the pretreatment unit is provided between the setting unit and the first transport unit, or between the first transport unit and the head unit. That is, the first transport unit and the pretreatment unit are provided on an upstream side in the transport direction of the target recording medium with respect to the head unit, and the pretreatment unit is provided on either an upstream side or a downstream side in the transport direction of the target recording medium with respect to the first transport unit. Therefore, depending on the contents of the pretreatment unit, it is possible to provide the pretreatment unit on either an upstream side or a downstream side in the transport direction of the target recording medium with respect to the first transport unit.

For example, in a case of performing printing recording using a recording device in a case in which the target recording medium is fabric, it is possible to improve recording quality by providing the pretreatment unit on an upstream side in the transport direction of the target recording medium with respect to the first transport unit.

In the recording device of the aspect of the invention, a post-treatment unit that attaches a post-treatment agent to a target recording medium on which recording has been performed by the head unit may be further provided, the second transport unit of the transport unit may be provided between the head unit and a recovery unit that recovers a target recording medium upon which recording has been performed by the head unit, and the post-treatment unit may be provided between the head unit and the second transport unit, or between the second transport unit and the recovery unit.

According to the aspect of the invention, the second transport unit is provided between the head unit and a recovery unit that recovers a target recording medium upon which recording has been performed by the head unit, and the post-treatment unit is provided between the head unit and the second transport unit, or between the second transport unit and the recovery unit. That is, the second transport unit and the post-treatment unit are provided on a downstream side in the transport direction of the target recording medium with respect to the head unit, and the post-treatment unit is provided on either an upstream side or a downstream side in the transport direction of the target recording medium with respect to the second transport unit. Therefore, depending on the contents of the post-treatment unit, it is possible to provide the post-treatment unit on either an upstream side or a downstream side in the transport direction of the target recording medium with respect to the second transport unit. It is possible to use various agents as the post-treatment agent depending on an objective thereof such as planarizing unevenness in the recording surface of the target recording medium, protecting the recording surface from ozone, light or water, or applying a high degree of glossiness to the recording surface.

In the recording device of the aspect of the invention, the post-treatment agent may be a gloss optimizer.

According to the aspect of the invention, the post-treatment agent is a gloss optimizer. Therefore, by providing the post-treatment unit on the upstream side in the transport direction of the target recording medium with respect to the second transport unit, it is possible to attach the post-treatment agent before drying the ink, and it is possible to improve recording quality.

In the recording device of the aspect of the invention, the post-treatment agent may be a liquid laminating agent.

According to the aspect of the invention, since the post-treatment agent is a liquid laminating agent, it is possible to laminate the target recording medium after recording. Additionally, it is possible to provide the post-treatment unit on either an upstream side or a downstream side in the transport direction of the target recording medium with respect to the second transport unit depending on a type of liquid laminating agent.

In the recording device of the aspect of the invention, the air delivery unit may deliver air in a direction that becomes separated from the head unit.

According to the aspect of the invention, the air delivery unit delivers air in a direction that becomes separated from the head unit. Therefore, it is possible to suppress a circumstance in which air that is delivered from the air delivery unit disrupts the direction of ink that is ejected from the head unit.

In the recording device of the aspect of the invention, a target recording medium support unit that is provided in a transport pathway of the transport unit, and a sensor that detects lifting of the target recording medium with respect to the support unit may be further provided.

According to the aspect of the invention, a sensor that detects lifting of the target recording medium with respect to the support unit is provided. Therefore, it is possible to detect lifting of the target recording medium using the sensor.

In the recording device of the aspect of the invention, it is possible to change an air volume of the air delivery unit in a case in which the sensor detects lifting of the target recording medium.

According to the aspect of the invention, it is possible to change an air volume of the air delivery unit in a case in which the sensor detects lifting of the target recording medium. Therefore, it is possible to resolve the lifting by performing a simple action of releasing the pushing of the target recording medium against the driving roller by changing (reducing) the air pressure of the air delivery unit in a case in which lifting of the target recording medium is detected by the sensor.

According to another aspect of the invention, there is provided a recording device in which a target recording medium is pushed against a driving roller using an air delivery unit, and the target recording medium is transported by rotating the driving roller.

According to the aspect of the invention, the target recording medium is pushed against the driving roller using the air delivery unit, and the target recording medium is transported by rotating the driving roller. That is, it is possible to transport the target recording medium without interposing the target recording medium between a pair of rollers. Therefore, it is possible to suppress transport defects such as the imprinting of roller tracks that accompany transport of the target recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device according to embodiments of the invention will be described in detail with reference to the appended drawings.

Figure 1:
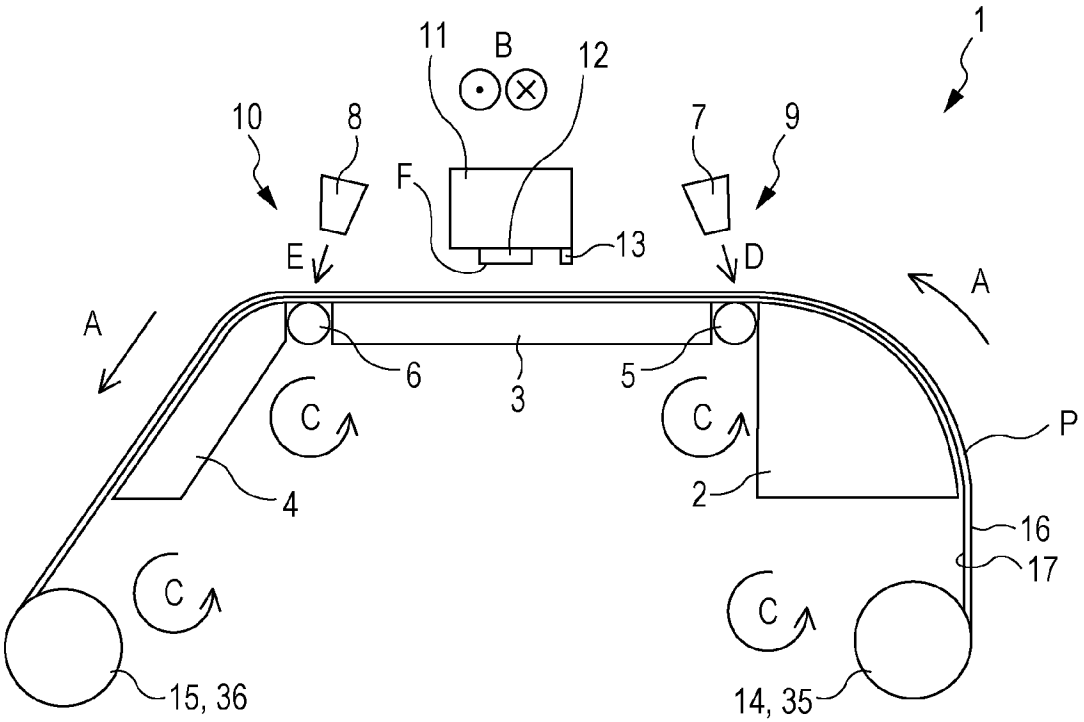
FIG. 1 is an outline side view that represents a recording device according to a first embodiment of the invention.
Figure 2:
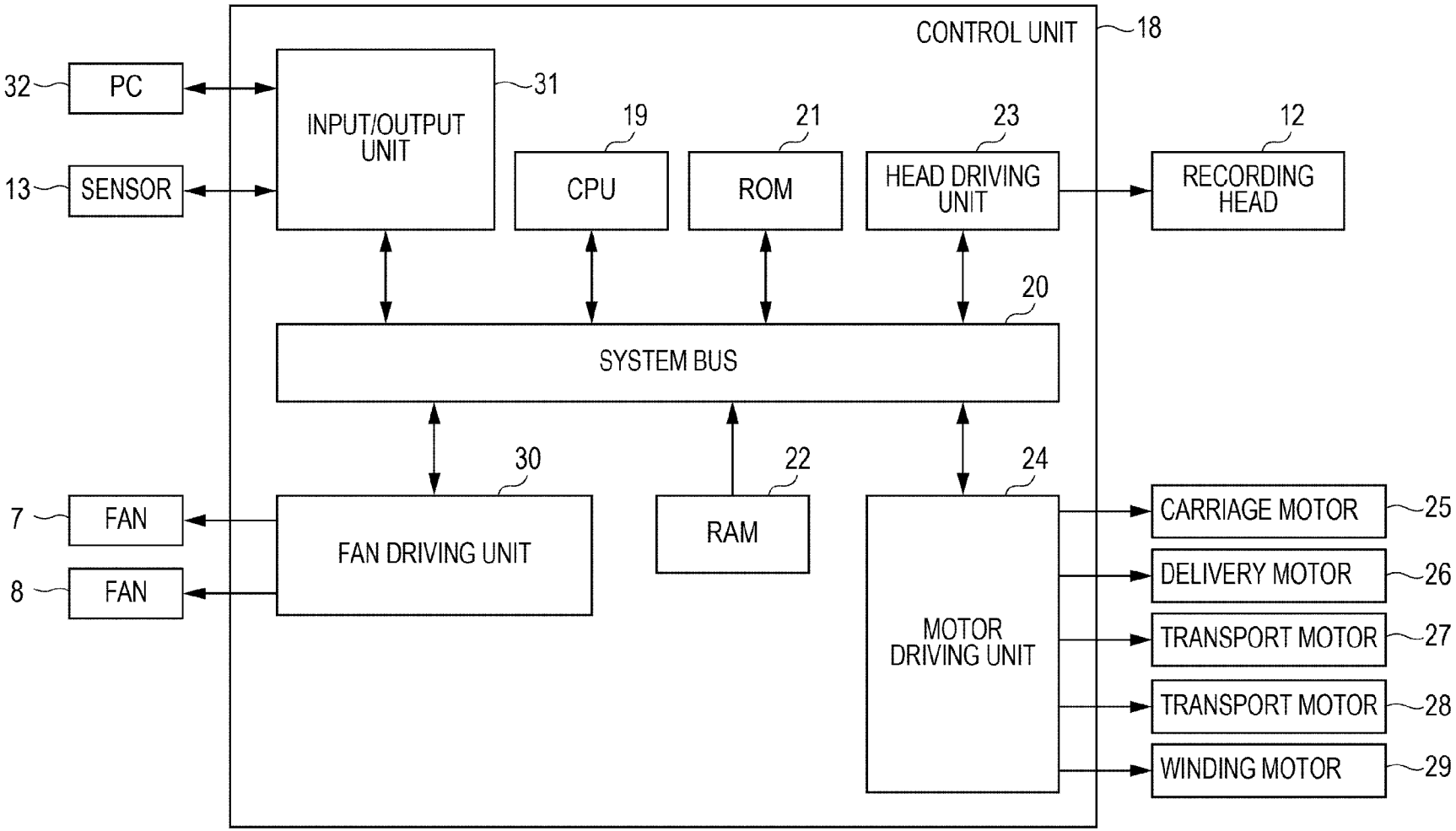
FIG. 2 is a block diagram of the recording device according to the first embodiment of the invention.

First Embodiment, FIG. 1 and FIG. 2

FIG. 1 is an outline side view that represents a recording device 1 according to a first embodiment of the invention.

The recording device 1 of the present embodiment transports a target recording medium P in a transport direction A from a setting unit 14 of the target recording medium P to a winding unit 15 of the target recording medium P using a platen 2, a platen 3 and a platen 4, which act as support units of the target recording medium P. That is, from the setting unit 14 to the winding unit 15, there is a transport pathway of the target recording medium P in the recording device 1. Furthermore, the platen 2, the platen 3 and the platen 4 are support units of the target recording medium P that are provided in the transport pathway. In this instance, the position of the setting unit 14 corresponds to a setting position 35 at which the target recording medium P is set, and the position of the winding unit 15 corresponds to a recovery position 36 at which the target recording medium P is recovered. Additionally, the setting unit 14 delivers the target recording medium P by rotating in a rotating direction C, and the winding unit 15 winds the target recording medium P by rotating in the rotating direction C.

Additionally, the recording device 1 of the present embodiment has a configuration that is capable of performing recording on a roll-shaped target recording medium P. However, the present embodiment is not limited to such a configuration. For instance, the present embodiment may have a configuration that is capable of performing recording on single sheets of target recording medium P. In a case of a configuration that is capable of performing recording on single sheets of target recording medium P, the setting unit 14 of the target recording medium P is for example, a unit that is referred to as a so-called paper supply (feeding) tray, a paper supply (feeding) cassette or the like; and the recovery position 36 of the target recording medium P is the position of the winding unit 15, but for example, examples of recovery units other than the winding unit 15 include a so-called receiving unit for discharge, or a unit that is referred to as a paper output (discharge) tray or a paper output (discharge) cassette.

In the recording device 1 of the present embodiment, a driving roller 5 is provided between the platen 2 and the platen 3. Furthermore, a fan 7, which is an air delivery unit, is provided above the driving roller 5. The fan 7 is capable of delivering air in a direction D that faces toward the driving roller 5. Further, it is possible to push the target recording medium P against the driving roller 5 using the air pressure of the fan 7. As a result of this kind of configuration, a first transport unit 9 is configured by the driving roller 5 and the fan 7.

In other words, the first transport unit 9 is provided with the driving roller 5 that is provided in a position that comes into contact with a first surface 17 (a surface that is on a side opposite the recording surface) of the target recording medium P, and that generates a delivery power in the target recording medium P; and the fan 7 as an air delivery mechanism that pushes the target recording medium P against the driving roller 5 by applying air pressure to the driving roller 5 from a side of a second surface 16 (a recording surface) of the target recording medium P.

In addition, in the recording device 1 of the present embodiment, a driving roller 6 is provided between the platen 3 and the platen 4. Furthermore, a fan 8, which is an air delivery unit, is provided above the driving roller 6. The fan 8 is capable of delivering air in a direction E that faces toward the driving roller 6. Further, it is possible to push the target recording medium P against the driving roller 6 using the air pressure of the fan 8. As a result of this kind of configuration, a second transport unit 10 is configured by the driving roller 6 and the fan 8.

In other words, the second transport unit 10 is provided with the driving roller 6 that is provided in a position that comes into contact with the first surface 17 of the target recording medium P, and that causes a delivery power to act on the target recording medium P; and the fan 8 as an air delivery mechanism that pushes the target recording medium P against the driving roller 6 using air pressure by delivering air toward the driving roller 6 from a side of the second surface 16 of the target recording medium P.

In this manner, the first transport unit 9 and the second transport unit 10 of the present embodiment can transport the target recording medium P without interposing (e.g., pressing) the target recording medium P between a pair of rollers. Therefore, transport defects such as the imprinting of roller tracks that accompany transport of the target recording medium P are suppressed. In particular, a configuration in which it is possible to prevent the trail of a driven roller from appearing on a side of the recording surface of the target recording medium P, is achieved.

In addition, in the recording device 1 of the present embodiment, a recording head unit 12 (which is a head unit) is provided on a side that opposes the platen 3. The recording device 1 forms a predetermined image by ejecting ink onto the target recording medium P from an ink ejection surface F of the recording head unit 12 while using a carriage 11 to perform reciprocating movement of the recording head unit 12 in a direction B that intersects the transport direction A.

Additionally, although the recording device 1 of the present embodiment is provided with a recording head unit 12 that records while performing reciprocating movement, the recording device might alternatively be provided with a so-called line head in which a plurality of nozzles that eject ink are provided in a direction that intersects the transport direction A.

In this instance, a "line head" refers to a recording head that is provided so that a region of the nozzles that are formed in an intersecting direction that intersects the transport direction A of the target recording medium P can cover the entirety of the intersecting direction of the target recording medium P, and that is used in a recording device that forms an image by fixing either one of a recording head or a target recording medium and moving the other. Additionally, the region of the nozzles of the intersecting direction of the line head need not necessarily cover the entirety of the intersecting directions of all of the target recording mediums P that the recording device can handle.

In addition, a sensor 13 that detects lifting of the target recording medium P with respect to the platen 3 is provided in the carriage 11. Therefore, it is possible to detect lifting of the target recording medium P using the sensor 13. By sensing lifting of the target recording medium P, it is possible to suppress interference between the target recording medium P and the recording head unit 12, and deteriorations in the quality of recording images of lifted portions. Additionally, in the recording device 1 of the present embodiment, the sensor 13 is provided in the carriage 11, but the sensor 13 may be provided in another location. A configuration that is not provided with the sensor 13 is also included in the invention.

In this instance, the recording device 1 of the present embodiment can change the air volumes of the fan 7 and fan 8 in a case in which the sensor 13 detects lifting of the target recording medium P. As a result of such a configuration, it is possible to release the pushing of the target recording medium P against the driving roller 5 and the driving roller 6 by changing (reducing) the air pressure of the fan 7 and the fan 8 in a case in which the sensor 13 detects lifting of the target recording medium P. Further, by performing this kind of simple action, a configuration in which it is possible to resolve the lifting is achieved.

In the abovementioned manner, the recording device 1 of the present embodiment is provided with a recording head unit 12 that records by ejecting ink onto the target recording medium P, and the transport units (the first transport unit 9 and the second transport unit 10) are provided on both sides (the first transport unit 9 on an upstream side in the transport direction A, and the second transport unit 10 on a downstream side in the transport direction A) of the recording head unit 12 in the transport direction A with the recording head unit 12 interposed therebetween. Therefore, since it is possible to push the target recording medium P against the driving rollers on both sides of the recording head unit 12 in the transport direction A (against the driving roller 5 on the upstream side in the transport direction A, and against the driving roller 6 on the downstream side in the transport direction A), transport faults such as jamming are effectively suppressed. However, a configuration in which a transport unit is provided on only one side of the recording head unit 12 in the transport direction A is also included in the invention.

In the abovementioned manner, the first transport unit 9 of the present embodiment is provided between the setting position 35 (the position of the setting unit 14) at which is set a target recording medium P on which recording by the recording head unit 12 is to be performed, and the recording head unit 12.

In this instance, the fan 7 of the first transport unit 9 is a fan that jets out ions. In other words, in the recording device 1 of the present embodiment, a fan that jets out ions is provided on the upstream side in the transport direction of the target recording medium P with respect to the recording head unit 12. Therefore, it is possible to further improve recording quality by removing static electricity of the target recording medium P using the ions prior to recording with the recording head unit 12. Therefore, it is possible to reduce costs by causing the first transport unit 9 to also have a role of a static electricity removal unit of the target recording medium P. Additionally, an ionizer in which an ion generator and a fan are integrally combined is a specific example of a fan that jets out ions, and is used in the present embodiment. However, the present embodiment is not limited to an ionizer. In addition, configurations that include fans other than fans that jet out ions are also included in the invention.

Additionally, the fan 7 of the first transport unit 9 of the present embodiment is a fan that jets out ions, but may be a fan that jets out hot air. According to this kind of configuration, it is possible to cause the first transport unit 9 to also have a role of a heating unit of the target recording medium P, and it is possible to reduce costs since it is not necessary to provide a separate heating unit.

In the manner described above, the second transport unit 10 is provided between the recording head unit 12, and the recovery position 36 (the position of the winding unit 15) at which is recovered a target recording medium P upon which recording by the recording head unit 12 has been performed.

In this instance, the fan 8 of the second transport unit 10 is a fan that jets out hot air. In other words, in the recording device 1 of the present embodiment, a fan that jets out hot air is provided on the downstream side in the transport direction of the target recording medium P with respect to the recording head unit 12. Therefore, it is possible to volatilize a volatile constituent in the ink that is ejected onto the target recording medium P using the hot air after recording has been performed by the recording head unit 12. Therefore, it is possible to reduce costs by causing the second transport unit 10 to also have a role of an ink drying unit. Additionally, a fan that has an internal heater is a specific example of a fan that jets out hot air, and is used in the present embodiment. However, the present embodiment is not limited to this kind of fan. In addition, configurations that include fans other than fan that jets out hot air are also included in the invention.

In addition, as represented by FIG. 1, the fan 7 of the first transport unit 9 and the fan 8 of the second transport unit 10 deliver air in a direction that directs away from the recording head unit 12. More specifically, the fan 7 delivers air in a direction D that faces toward the upstream side in the transport direction A, and the fan 8 delivers air in a direction E that faces toward the downstream side in the transport direction A. Therefore, a circumstance in which air that is delivered from the fan 7 and the fan 8 disrupts the direction of ink that is ejected from the recording head unit 12 is suppressed. Additionally, although the fan 7 and the fan 8 in the present embodiment deliver air so that air flows in direction that is away from the position of the recording head, the fan 7 and the fan 8 may alternatively deliver air so that air flows in direction that intersects a direction in which the recording head is positioned. However, configurations in which the air delivery direction of at least one of the fan 7 and the fan 8 is a direction that faces toward the recording head unit 12 are also included in the invention.

Next, the electrical configuration of the recording device 1 of the present embodiment will be described.

FIG. 2 is a block diagram of the recording device 1 of the present embodiment.

A CPU 19 that manages the control of the entire recording device 1 is provided in a control unit 18. The CPU 19 is connected to a ROM 21 in which various control programs and maintenance sequences that the CPU 19 executes are stored, and is connected to a RAM 22 that is capable of temporarily storing data through a system bus 20.

In addition, the CPU 19 is connected to a head driving unit 23 for driving the recording head unit 12 through the system bus 20.

In addition, the CPU 19 is connected to a carriage motor 25 for moving the carriage 11, and a motor driving unit 24. The motor driving unit 24 is configured to drive a delivery motor 26 (which is a driving source of the setting unit 14), a transport motor 27 (which is a driving source of the driving roller 5), a transport motor 28 (which is a driving source of the driving roller 6), and a winding motor 29 (which is a driving source of the winding unit 15, through the system bus 20).

In addition, the CPU 19 is connected through the system bus 20 to a fan driving unit 30 for driving the fan 7 and the fan 8.

Furthermore, the CPU 19 is connected to an input/output unit 31 through the system bus 20. The input/output unit 31 is connected to the sensor 13 and a PC 32, which is an external device that inputs recording data or the like into the recording device 1.

Figure 3:
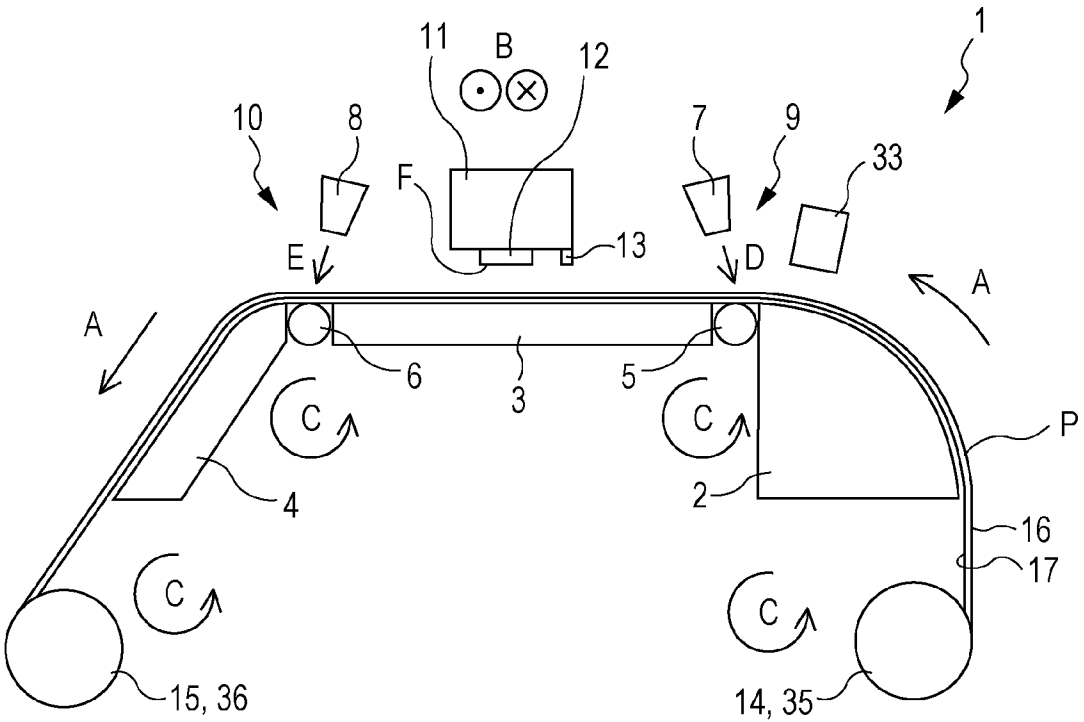
FIG. 3 is an outline side view that represents a recording device according to a second embodiment of the invention.

Second Embodiment, FIG. 3

Next, a recording device of a second embodiment will be described in detail with reference to the appended drawings.

FIG. 3 represents an outline side view of a recording device 1 of the present embodiment. Additionally, the same reference numerals will be given to constituent members that are common to the abovementioned embodiment, and detailed description thereof will be omitted.

Additionally, other than including a pretreatment unit 33, the recording device 1 of the present embodiment has the same configuration as that of the recording device 1 of the first embodiment.

The recording device 1 of the present embodiment is capable of printing recording using fabric as the target recording medium, and is provided with a pretreatment unit 33 that is capable of applying a pretreatment agent that suppresses the smearing of ink between the setting unit 14 and the fan 7 in the transport direction A. Therefore, the fan 7 also has a role as a drying unit that dries the pretreatment agent that has been applied by the pretreatment unit 33. The recording device 1 has this kind of configuration since it is assumed that ink is recorded when the pretreatment agent that is used in the present embodiment is in a dried state. However, the recording device 1 is not limited to this kind of configuration. In a case that uses a pretreatment agent that assumes that ink is recorded in a state before drying of the pretreatment agent, or depending on the type of pretreatment agent, the recording device 1 may have a configuration in which the pretreatment unit 33 is provided between the fan 7 and the recording head unit 12 in the transport direction A. In addition, the recording device 1 may also be a recording device that records on a material other than fabric as the target recording medium.

In other words, the recording device 1 of the present embodiment is provided with a pretreatment unit 33 that attaches a pretreatment agent that suppresses the smearing of ink on the target recording medium P, the recording head unit 12 records by ejecting ink onto a target recording medium P to which the pretreatment agent has been attached, the first transport unit 9 is provided between the setting position 35 at which a target recording medium P on which recording by the recording head unit 12 is to be performed, is set and the recording head unit 12, and the pretreatment unit 33 is provided between the setting position 35 and the first transport unit 9, or between the first transport unit 9 and the recording head unit 12.

That is, the first transport unit 9 and the pretreatment unit 33 are provided on an upstream side in the transport direction of the target recording medium P with respect to the recording head unit 12, and the pretreatment unit 33 is provided on either an upstream side or a downstream side in the transport direction of the target recording medium with respect to the first transport unit 9.

Therefore, depending on the content of the pretreatment, it is possible to provide the pretreatment unit 33 on either an upstream side or a downstream side in the transport direction of the target recording medium P with respect to the first transport unit 9.

The recording device 1 of the present embodiment is capable of printing recording using fabric as the target recording medium, and has a configuration that improves recording quality by providing the pretreatment unit 33 on an upstream side in the transport direction of the target recording medium P with respect to the first transport unit 9.

Figure 4:
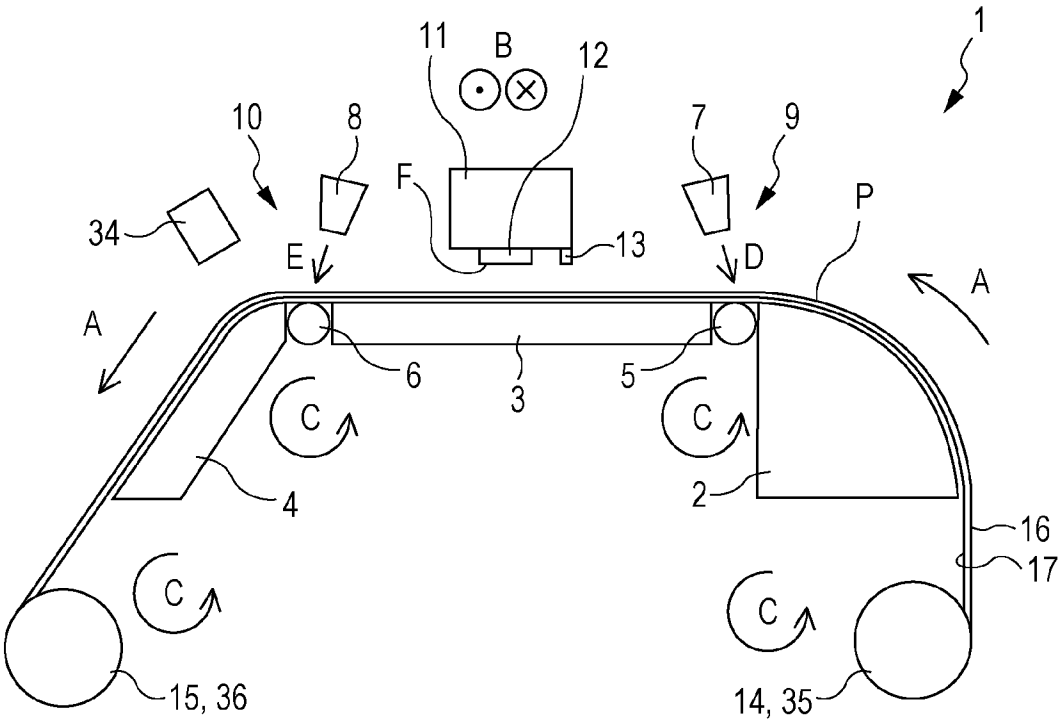
FIG. 4 is an outline side view that represents a recording device according to a third embodiment of the invention.

Third Embodiment, FIG 4.

Next, a recording device of a third embodiment will be described in detail with reference to the appended drawings.

FIG. 4 represents an outline side view of a recording device 1 of the present embodiment. Additionally, the same reference numerals will be given to constituent members that are common to the abovementioned embodiment, and detailed description thereof will be omitted.

Additionally, other than including a post-treatment unit 34, the recording device 1 of the present embodiment has the same configuration as that of the recording device 1 of the first embodiment.

The recording device 1 of the present embodiment is provided with a post-treatment unit 34 that is capable of applying a post-treatment agent, which is a liquid laminating agent between the fan 8 and the winding unit 15 in the transport direction A. Therefore, in addition to causing the fan 8 to also have a role as a drying unit of ink, the fan 8 has an additional role as a drying unit that dries the post-treatment agent that has been applied by the post-treatment unit 34. The recording device 1 has this kind of configuration since it is assumed that the post-treatment agent that is used in the present embodiment is applied in a state in which ink has dried. However, the recording device 1 is not limited to this kind of configuration. In a case that uses a post-treatment agent that assumes that application is performed in a state before ink has dried, or depending on the type of post-treatment agent, the recording device 1 may have a configuration in which the post-treatment unit 34 is provided between the recording head unit 12 and the fan 8 in the transport direction A.

In other words, the recording device 1 of the present embodiment is provided with the recording head unit 12 that records by ejecting ink onto a target recording medium P, and the post-treatment unit 34 that attaches a post-treatment agent to a target recording medium P on which recording has been performed by the recording head unit 12, the second transport unit 10 is provided between the recording head unit 12 and the recovery position 36 (the position of the winding unit 15) from which a target recording medium P upon which recording by the recording head unit 12 has been performed, is recovered, and the post-treatment unit 34 is provided between the recording head unit 12 and the second transport unit 10, or between the second transport unit 10 and the recovery position 36.

That is, the second transport unit 10 and the post-treatment unit 34 are provided on a downstream side in the transport direction of the target recording medium P with respect to the recording head unit 12, and the post-treatment unit 34 is provided on either an upstream side or a downstream side in the transport direction of the target recording medium P with respect to the second transport unit 10.

Therefore, depending on the content of the post-treatment, it is possible to provide the post-treatment unit 34 on either an upstream side or a downstream side in the transport direction of the target recording medium P with respect to the second transport unit 10. It is possible to use various agents as the post-treatment agent depending on an objective thereof such as planarizing unevenness in the recording surface of the target recording medium, protecting the recording surface from ozone, light or water, or applying a high degree of glossiness to the recording surface.

For example, in a case of performing a post-treatment that records a gloss optimizer as the post-treatment agent, by providing the post-treatment unit 34 on the upstream side in the transport direction of the target recording medium with respect to the second transport unit 10, it is possible to attach the post-treatment agent before ink is completely dried, and it is possible to improve recording quality.

In addition, in a case of performing a post-treatment that attaches a liquid laminating agent as the post-treatment agent in the manner of the recording device 1 of the present embodiment, it is possible to laminate the target recording medium P after recording. In addition, it is possible to provide the post-treatment unit 34 on either an upstream side or a downstream side in the transport direction of the target recording medium P with respect to the second transport unit 10 depending on the type of liquid laminating agent.

Figure 5:
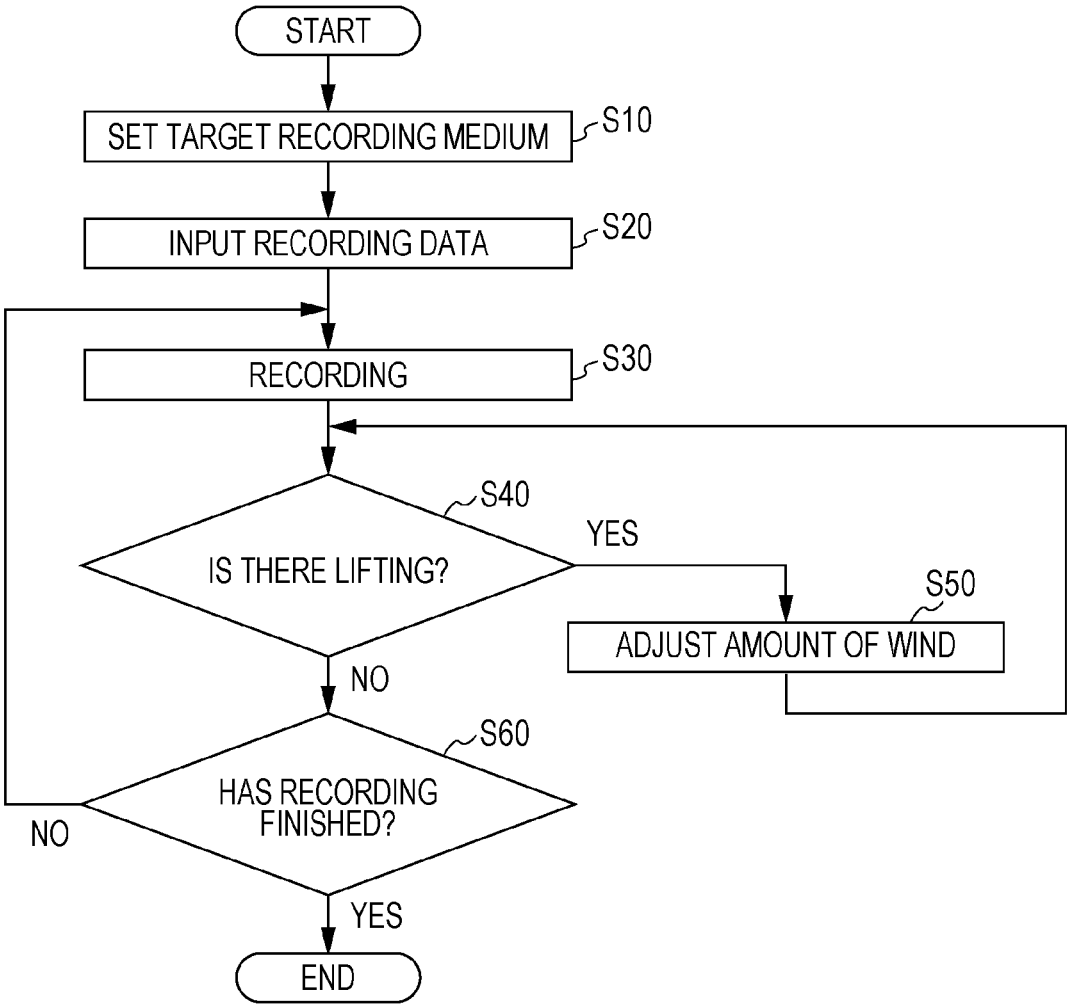
FIG. 5 is a flowchart of a recording method according to an embodiment of the invention.

Embodiment of Recording Method, FIG. 5

Next, an embodiment of a recording method that is used in the recording device 1 of the first embodiment will be described. More specifically, a recording method that includes a flow up until the detection of lifting of the target recording medium P and the resolution of the lifting will be described.

FIG. 5 is a flowchart of a recording method of the present embodiment.

Initially, in Step S10, a user sets a target recording medium P in the recording device 1. More specifically, in the present embodiment, a user installs a roll-shaped target recording medium P in the setting unit 14, and the target recording medium P is set in the recording device 1 by delivering air from the fan 7 and the fan 8 after the target recording medium P has been delivered in the transport direction A. Additionally, at this time, the ion generator of the fan 7 and the heater of the fan 8 may be in a state in which the power thereof is still OFF.

Next, in Step S20, recording data is input to the recording device 1 from the PC 32.

Additionally, in a case in which the power of the ion generator of the fan 7 is OFF in Step S10, the power of the ion generator of the fan 7 is turned ON in this step.

Next, in Step S30, recording is executed on the basis of the recording data. This recording is performed by recording while performing reciprocating movement of the recording head unit 12.

Additionally, in a case in which the power of the heater of the fan 8 is OFF in Step S10, the power of the heater of the fan 8 is turned ON in this step.

Along with this recording, in Step S40, the detection of lifting of the target recording medium P is performed by the sensor 13 for each single recording scan in the reciprocating movement of the recording head unit 12.

In a case in which lifting of the target recording medium P is detected by the sensor 13 in Step S40, the process proceeds to Step S50, and the air volumes of the fan 7 and the fan 8 are adjusted. Additionally, the control of the adjustment of the air volumes is performed by the control unit 18, and in the present embodiment, the driving of the fan 7 and the fan 8 is stopped in a case in which the lifting of the target recording medium P is detected. In this manner, by releasing the target recording medium P from being pushed against the platen 3 by air pressure, the lifting of the target recording medium P is resolved. Further, the process returns to Step S40, and the detection of lifting (confirmation of the fact that the lifting of the target recording medium P has been resolved) of the target recording medium P is performed again.

Additionally, in the present embodiment, in a case in which lifting of the target recording medium P is detected, the driving of the fan 7 and the fan 8 is stopped, but a configuration that stops the driving of either one, and a configuration that reduces the air volume rather than stopping the driving, are also possible.

In particular, if a configuration that resolves the lifting of the target recording medium P by stopping the driving of the fan 8 without stopping the fan 7 is adopted, it is preferable since it is possible to suppress shifting of the position of the target recording medium P during resolution of the lifting of the target recording medium P. Additionally, among such configurations, a configuration in which the air direction of air that is delivered from the fan 8 is a vertical direction is more preferable since it is possible to particularly suppress shifting of the position of the target recording medium P during resolution of the lifting of the target recording medium P.

In a case in which lifting of the target recording medium P is not detected by the sensor 13 in Step S40, the process proceeds to Step S60, the recording of all recording data that was input in Step S20 is performed, and the control unit 18 determines whether or not recording has been completed.

Further, in Step S60, in a case in which it is determined that recording has not been completed, the process returns to Step S30. Additionally, in the flow from Step S30 to Step S60, the recording of all recording data that was input in Step S20 is performed in each single recording scan in the reciprocating movement of the recording head unit 12, and is performed until it is determined that recording has been completed. Further, in a case in which it is determined that recording has been completed, the recording method of the present embodiment is completed.

If the abovementioned description is summarized, the recording devices 1 of embodiments 1 to 3 are characterized by pushing the target recording medium P against the driving rollers 5 and 6 using the air delivery units (the fan 7 and the fan 8), and transporting the target recording medium P by rotating the driving rollers 5 and 6.

As a result of this kind of configuration, it is possible to transport the target recording medium P without interposing the target recording medium P between a pair of rollers. Therefore, it is possible to suppress transport defects such as the imprinting of roller tracks that accompany transport of the target recording medium P.

What is claimed is:

1. A recording device comprising:

a head unit that ejects ink onto a target recording medium; and a transport unit that transports the target recording medium, wherein the transport unit is provided with a driving roller unit that is provided so as to come into contact with a first surface of the target recording medium, and that generates a delivery power in the target recording medium, an air delivery unit that pushes the target recording medium against the driving roller by applying air pressure to the driving roller from a side of a second surface of the target recording medium, a target recording medium support unit that is provided in a transport pathway of the transport unit, and a sensor that detects lifting of the target recording medium with respect to the support unit.

2. The recording device according to claim 1, wherein, the transport unit includes, in a transport direction of the target recording medium, a first transport unit that is provided on an upstream side in the transport direction of the head unit, and a second transport unit that is provided on a downstream side in the transport direction of the head unit.

3. The recording device according to claim 2, wherein the first transport unit of the transport unit is provided between a setting unit that sets the target recording medium on which recording is to be performed by the head unit, and the head unit, and the air delivery unit is a fan that jets out ions or a fan that jets out hot air.

4. The recording device according to claim 2, wherein the second transport unit of the transport unit is provided between the head unit and a recovery unit that recovers a target recording medium upon which recording has been performed by the head unit, and the air delivery unit is a fan that jets out hot air.

5. The recording device according to claim 2 further comprising:

a pretreatment unit that attaches a pretreatment agent that suppresses smearing of ink to the target recording medium, wherein the head unit records by ejecting the ink onto the target recording medium to which the pretreatment agent has been attached, wherein the first transport unit of the transport unit is provided between a setting unit that sets the target recording medium on which recording is to be performed by the head unit, and the head unit, and wherein the pretreatment unit is provided between the setting unit and the first transport unit, or between the first transport unit and the head unit.

6. The recording device according to claim 2 further comprising:

a post-treatment unit that attaches a post-treatment agent to a target recording medium on which recording has been performed by the head unit, wherein the second transport unit of the transport unit is provided between the head unit and a recovery unit that recovers a target recording medium upon which recording has been performed by the head unit, and wherein the post-treatment unit is provided between the head unit and the second transport unit, or between the second transport unit and the recovery unit.

7. The recording device according to claim 6, wherein the post-treatment agent is a gloss optimizer.

8. The recording device according to claim 6, wherein the post-treatment agent is a liquid laminating agent.

9. The recording device according to claim 2, wherein the air delivery unit delivers air in a direction that becomes separated from the head unit.

10. The recording device according to claim 1, wherein it is possible to change an air volume of the air delivery unit in a case in which the sensor detects lifting of the target recording medium.

11. A recording device, wherein a target recording medium is pushed against a driving roller using an air delivery mechanism, and the target recording medium is transported by rotating the driving roller, wherein the recording device includes a target recording medium support unit in a transport pathway of the recording device, and a sensor that detects lifting of the target recording medium with respect to the support unit.

12. A method for recording on a target recording medium, the method comprising:

delivering the target recording medium to an ink ejection head unit using a driving roller that comes into contact with a first surface of the target recording medium;

while delivering the target recording medium, detecting by a sensor that the target recording medium has lifted off of a recording medium support unit; and in response to detecting the lifting, applying air pressure onto a second surface of the target recording medium to push the target recording medium against the driving roller.

* * * * *